US010065412B2

(12) United States Patent
Shinjo et al.

(10) Patent No.: US 10,065,412 B2
(45) Date of Patent: Sep. 4, 2018

(54) INK JET RECORDING METHOD

(71) Applicant: CANON KABUSHIKI KAISHA, Tokyo (JP)

(72) Inventors: Kenji Shinjo, Yokohama (JP); Yoshitaka Torisaka, Tokyo (JP); Shinichi Sakurada, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 136 days.

(21) Appl. No.: 15/168,513

(22) Filed: May 31, 2016

(65) Prior Publication Data

US 2016/0368285 A1 Dec. 22, 2016

(30) Foreign Application Priority Data

Jun. 19, 2015 (JP) ..... 2015-124033

(51) Int. Cl.

| | |
|---|---|
| ***B41J 2/21*** | (2006.01) |
| ***B41J 2/01*** | (2006.01) |
| ***B41M 5/00*** | (2006.01) |

(52) U.S. Cl.

CPC ..... *B41J 2/01* (2013.01); *B41J 2/2107* (2013.01); *B41M 5/0017* (2013.01)

(58) Field of Classification Search

CPC ... B41J 2/01; B41J 2/211; B41J 2/1433; B41J 2/17; B41J 2/17593; B41J 2/2107; B41J 2/1755; B41J 2/2114; B41J 2/2117; B41J 11/0015; B41J 11/002; B41J 2/2056; B41J 2/21; B41J 2/0057; B41J 3/60; B41J 2002/012; B41J 2/04598; C09D 11/36; C09D 11/40; C09D 11/30; C09D 11/38; C09D 11/322; C09D 11/328; C09D 11/101; C09D 11/005; C09D 11/54; C09D 11/52; B41M 5/0011; B41M 5/0017; B41M 7/00; B41M 7/0072; B41M 5/52; B41M 5/5218; B41M 2/04588; B41M 2/04595; B41M 2/04586; B41M 2/14274

See application file for complete search history.

(56) References Cited

U.S. PATENT DOCUMENTS

| | | | |
|---|---|---|---|
| 6,114,020 | A | 9/2000 | Misuda et al. |
| 6,391,440 | B1 | 5/2002 | Yoshino et al. |
| 6,670,000 | B1 | 12/2003 | Misuda et al. |
| 6,730,375 | B2 | 5/2004 | Moriya et al. |

(Continued)

FOREIGN PATENT DOCUMENTS

| | | |
|---|---|---|
| JP | 2010-065170 A | 3/2010 |
| JP | 2011-173330 A | 9/2011 |

OTHER PUBLICATIONS

Robert F. Fedors, "A Method for Estimating Both the Solubility Parameters and Molar Volumes of Liquids," Polymer Engineering and Science, vol. 14, No. 2, Feb. 1974, pp. 147-154.

*Primary Examiner* — Manish S Shah

(74) *Attorney, Agent, or Firm* — Fitzpatrick, Cella, Harper & Scinto

(57) ABSTRACT

An ink jet recording method including the steps of applying onto a recording medium a treatment liquid containing a component which causes ink viscosity increase and a compound A having a polyalkylene glycol ether structure and having only one hydroxy group; and applying an ink onto the recording medium. The cloud point of the compound A measured by using a 1% by mass concentration aqueous solution of the compound A is 50° C. or more.

14 Claims, 1 Drawing Sheet

(56) References Cited

U.S. PATENT DOCUMENTS

| | | | | |
|---|---|---|---|---|
| 6,783,229 | B1 | 8/2004 | Inamoto et al. | |
| 6,811,839 | B2 | 11/2004 | Hiro et al. | |
| 6,966,944 | B2 | 11/2005 | Shimomura et al. | |
| 7,208,032 | B2 | 4/2007 | Hakamada et al. | |
| 7,297,194 | B2 | 11/2007 | Shinjo et al. | |
| 7,517,073 | B2 | 4/2009 | Nito et al. | |
| 7,517,074 | B2 | 4/2009 | Hakamada et al. | |
| 8,124,791 | B2 | 2/2012 | Shinjo et al. | |
| 8,158,746 | B2 | 4/2012 | Shinjo | |
| 8,408,690 | B2 | 4/2013 | Harada et al. | |
| 8,530,543 | B2 | 9/2013 | Yanagi et al. | |
| 8,845,085 | B2 | 9/2014 | Kobayashi et al. | |
| 8,870,339 | B2 | 10/2014 | Tojo et al. | |
| 8,939,570 | B2 | 1/2015 | Mori et al. | |
| 8,940,373 | B2 | 1/2015 | Shinjo et al. | |
| 9,051,484 | B2 | 6/2015 | Shinjo et al. | |
| 2004/0231556 | A1* | 11/2004 | Shimomura | B41J 11/0005 106/31.43 |
| 2007/0134451 | A1* | 6/2007 | Hakamada | B41M 5/52 428/32.38 |
| 2007/0209551 | A1* | 9/2007 | Fukuda | B41J 2/14056 106/31.58 |
| 2010/0062160 | A1 | 3/2010 | Yanagi et al. | |
| 2010/0245508 | A1* | 9/2010 | Ikeda | B41M 5/0011 347/95 |
| 2011/0104453 | A1 | 5/2011 | Shinjo et al. | |
| 2011/0205290 | A1 | 8/2011 | Tojo et al. | |
| 2013/0286069 | A1* | 10/2013 | Aoyama | B41J 2/21 347/43 |
| 2015/0009268 | A1 | 1/2015 | Sakurada | |
| 2016/0075899 | A1 | 3/2016 | Imai et al. | |

* cited by examiner

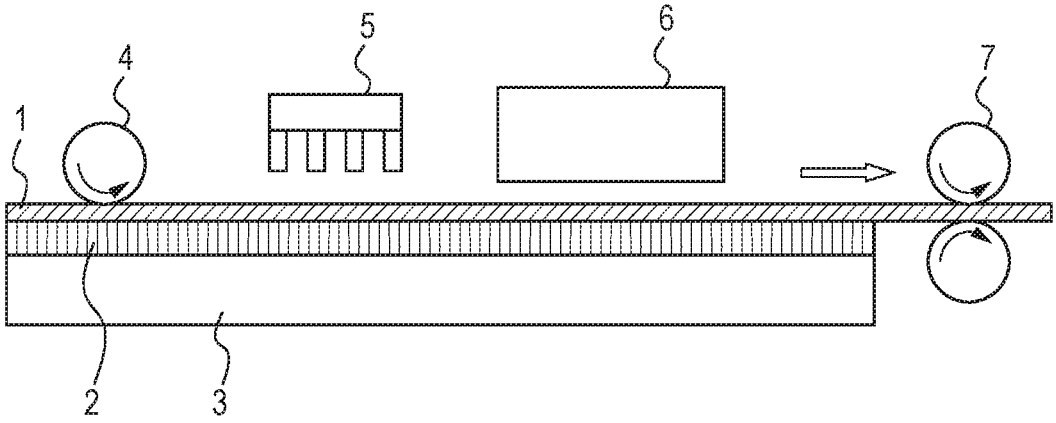
1
2
3
4
5
6
7

INK JET RECORDING METHOD

BACKGROUND OF THE INVENTION

Field of the Invention

The present invention relates to an ink jet recording method.

Description of the Related Art

In recent years, from the viewpoint of increasing the quality of a recording image and the speed of image formation, a so-called two-liquid printing method which uses a liquid containing no coloring materials (which may be referred to as "treatment liquid" or "reaction liquid" and will be hereinafter referred to as "treatment liquid") as well as an aqueous ink has been employed mainly to enhance the image quality. In the treatment liquid used in such a two-liquid printing method, a component that increases the viscosity of ink (specifically, a coloring material in the ink, for example) is generally added.

For example, there is mentioned a two-liquid printing method using an aggregation reaction caused by contact between an anionic ink containing pigments and a treatment liquid containing an organic acid and a polyvalent metal salt. Such a two-liquid printing method generally has a feature of obtaining an image with high resolution, high image density, and less bleeding at high speed, as compared to conventional printing methods using ink only.

On the other hand, a printed product obtained by an ink jet recording method has poor blocking resistance in some cases.

Examples of a typical antiblocking technique for a printed product include a technique of applying beads onto printing surfaces so as to prevent contact of the printing surfaces and a technique of adding wax to ink so as to prevent sticking of printing surfaces.

Similar techniques in the ink jet recording method are proposed in, for example, Japanese Patent Application Laid-Open No. 2010-065170 and Japanese Patent Application Laid-Open No. 2011-173330. In Japanese Patent Application Laid-Open No. 2010-065170, to enhance blocking resistance, polymer particles are included in an ink containing a coloring material, and the minimum film forming temperature (MFT) of the polymer particles is controlled.

In Japanese Patent Application Laid-Open No. 2011-173330, a treatment liquid containing a component which causes ink viscosity increase is applied onto a recording medium, an ink jet image is formed, and then, another treatment liquid containing wax and water and having a coloring material content of less than 0.1% by mass is applied onto an image area of a recorded image.

SUMMARY OF THE INVENTION

The present invention provides an ink jet recording method including the steps of applying onto a recording medium a treatment liquid containing a component which causes ink viscosity increase and a compound A having a polyalkylene glycol ether structure and having only one hydroxy group; and applying an ink onto the recording medium, wherein a cloud point of the compound A measured by using a 1% by mass concentration aqueous solution of the compound A is 50° C. or more.

The ink jet recording method according to the present invention can obtain a high-quality image with less bleeding even in the case of conveying the recording medium at high speed (e.g., 1 m/sec or more), and can obtain a printed product while suppressing a blocking phenomenon.

Further features of the present invention will become apparent from the following description of exemplary embodiments with reference to the attached drawings.

BRIEF DESCRIPTION OF THE DRAWINGS

FIGURE is a cross-sectional view schematically illustrating an image forming apparatus used in examples.

DESCRIPTION OF THE EMBODIMENTS

Preferred embodiments of the present invention will now be described in detail in accordance with the accompanying drawings.

For high-speed printing, it is known that the amount of application of a treatment liquid containing an ink-viscosity-increasing component is preferably increased, from the viewpoint of aggregation rate. To effectively increase the amount of application of the treatment liquid, it is effective to apply the treatment liquid by a typical application method. In this case, the treatment liquid can be used for high-speed printing by increasing the concentration of the ink-viscosity-increasing component (e.g., organic acid) contained in the treatment liquid.

Investigation of inventors of the present invention, however, revealed that this method can cause serious problems. Specifically, in addition to a region of the recording medium on which an image is formed by the ink jet recording method (image drawing part), the treatment liquid is applied to a region of the recording medium except the image drawing part (image non-drawing part). Thus, it was revealed that in the case of stacking printed products immediately after large-volume printing, a blocking phenomenon derived from the non-drawing parts can occur in some cases.

To prevent the blocking phenomenon, Japanese Patent Application Laid-Open No. 2010-065170 provides measures for an ink containing a coloring material, but these measures are effective only for image drawing parts. Thus, the effect of blocking resistance is not expected to be obtained against the blocking phenomenon derived from the image non-drawing parts.

In Japanese Patent Application Laid-Open No. 2011-173330, a treatment liquid containing wax is applied in a post process subsequent to a two-liquid printing method, and thus blocking resistance, especially blocking resistance on image non-drawing parts, immediately after printing is not suggested.

An object of the present invention is to provide an ink jet recording method that can obtain a high-quality image with less bleeding even in the case of conveying a recording medium at high speed (e.g., 1 m/sec or more), and can obtain a printed product while suppressing a blocking phenomenon.

The present invention provides an ink jet recording method (image recording method) including the steps of applying a treatment liquid onto a recording medium and applying an ink (e.g., anionic ink containing pigment) onto the recording medium, wherein a treatment liquid described below is used.

The treatment liquid contains a component that increases the viscosity of ink when coming into contact with the ink (ink-viscosity-increasing component) and a compound A having a polyalkylene glycol ether structure and including only one hydroxy group. The cloud point of the compound A measured by using a 1% by mass concentration aqueous solution of the compound A is 50° C. or more.

Known examples of the ink-viscosity-increasing component contained in aqueous treatment liquid include polyvalent metal salts, cationic polymers, and organic acids. These ink-viscosity-increasing components, however, tend to be sticky, and immediately after printing, sticky surfaces of image non-drawing parts can cause a blocking phenomenon between printed products in some cases. In addition, if the amount of application of the treatment liquid is increased to increase the rate of aggregation, the blocking phenomenon tends to be promoted.

In view of the foregoing problems, the inventors of the present invention have intensively made a study to find a new technique for suppressing a blocking phenomenon of printed products without decreasing the efficiency of increasing ink viscosity by adding to a treatment liquid a compound A having a specific cloud point and a polyalkylene glycol ether structure and having only one hydroxy group. The present invention is especially effective in the case of using a multifunctional hydroxy acid, which is an organic acid, as an ink-viscosity-increasing component. The use of the specific compound A together with the multifunctional hydroxy acid can easily reduce stickiness of image non-drawing parts after printing and can also suppress yellowing of a recording medium.

The mechanism of the present invention is not clarified, but is supposed to be as follows.

A blocking phenomenon tends to occur when surfaces of printed products with surface charge attract each other. Here, a treatment liquid used in the present invention contains a monovalent higher alcohol having a cloud point of a specific temperature or more and having a polyalkylene glycol ether structure. The compound A is supposed to form micelles in the treatment liquid and to form micelles with a hydrophilic part thereof, that is, a hydroxy group part, facing outward in a condition of a large moisture content. It is, however, supposed that as the treatment liquid is applied onto a recording medium and drying proceeds to decrease the moisture content, a hydrophobic part, that is, a long chain alkyl group showing high lipophilicity, in the compound A shows phase inversion at the surface of micelles because the compound A has the cloud point. In addition, since the compound A is normally in a liquid state even when used solely, phase inversion can easily take place, and thus the compound A can be easily oriented on the recording medium. Consequently, in the treatment liquid on the recording medium (sheet surface), the hydrophobic part of the compound A is oriented upward (in the direction opposite to the sheet surface) so that the compound A becomes electrically neutral. This state is assumed to suppress a blocking phenomenon caused by attraction between surfaces with surface charge.

It is also assumed that in a case where one or more polyalkyleneoxy groups of the compound A are propyleneoxy groups showing steric hindrance, the phase-inversion emulsified state (phase-inversion micelle state) becomes unstable so that micelles are easily broken. As a result, the tendency of orientation of the compound A on the recording medium in which hydrophobic parts face upward is expected to increase so that the effect of suppressing a blocking phenomenon is enhanced immediately after printing.

In the present invention, the use of a treatment liquid including an ink-viscosity-increasing component and a monovalent higher alcohol having a specific structure and a cloud point of a specific temperature or more enables achievement of both advantages (1) and (2) below:

(1) the use of the treatment liquid (reaction liquid) can reduce the influence of stickiness on printed products caused by the treatment liquid to suppress a blocking phenomenon caused by the treatment liquid when printed products are stacked; and (2) the suppression of the blocking phenomenon caused by the treatment liquid can increase the concentration of a treatment liquid aggregation component, that is, the ink-viscosity-increasing component, and thus, can enhance the aggregation rate so that even at a high conveyance speed of 1 m/sec or more, a high-quality image with less bleeding can be obtained.

Components of the treatment liquid and ink usable for the ink jet recording method according to the present invention will now be described.

Treatment Liquid

Treatment liquid used in the present invention necessarily includes a component which causes ink viscosity increase (ink-viscosity-increasing component) and a compound A having a polyalkylene glycol ether structure. The cloud point of the compound A measured by using a 1% by mass concentration aqueous solution of the compound A is 50° C. or more. The treatment liquid can contain an appropriate amount of a solvent (or a dispersion medium) such as water and an organic solvent and other components such as an additive. The treatment liquid preferably does not include a coloring material such as pigments or dyes for forming a recording image. In this manner, an aggregation reaction can easily occur for all types of ink so that a multicolor expression in a wide color range can be obtained in subtractive color mixture.

Ink-Viscosity-Increasing Component

The ink-viscosity-increasing component can serve as an aggregation agent for aggregating and increasing the viscosity of ink (e.g., anionic ink) used for forming an image on a recording medium.

The ink viscosity increase herein includes not only a case where a viscosity increase in the entire ink caused by contact between ink (ink composition) and the ink-viscosity-increasing component is observed but also a case where a local viscosity increase due to aggregation of some of components in the ink occurs.

In image formation using an ink jet device, the amount of ink application per unit area is large in some cases. In such a case, a bleeding phenomenon and a beading phenomenon, which are bleeding or mixing of ink, tend to occur. The ink-viscosity-increasing component, however, has an advantage of suppressing the bleeding phenomenon and the beading phenomenon during image formation by reducing fluidity of the entire ink or some components of the ink on the recording medium. Specifically, since the treatment liquid containing the ink-viscosity-increasing component is applied onto the recording medium, fluidity of ink decreases at the same time as image formation using the ink so that the bleeding phenomenon and the beading phenomenon do not tend to occur. As a result, an image can be suitably formed and held on the recording medium.

In the present invention, from the viewpoint of aggregation of a coloring material (e.g., anionic coloring material), at least one of a polyvalent metal salt, a cationic polymer and an organic acid is preferably used as the ink-viscosity-increasing component. Among these components, from the viewpoint of rapid aggregation, the treatment liquid more preferably contains at least an organic acid as the ink-viscosity-increasing component, because protons in an organic acid quickly come into contact with ink in a solution due to a propagation effect. One type of these ink-viscosity-increasing components may be used solely, or two or more types of ink-viscosity-increasing components may be used in combination.

Organic Acid

The type of the organic acid usable in the present invention is not specifically limited. In consideration of reaction with functional groups (e.g., carboxylic acid groups and carboxylate groups) of components in the ink, however, the organic acid preferably has a pKa of lower than 4.5.

Examples of such acid whose pKa is less than 4.5 include an organic acid (organic compound) having a carboxylic acid group, an organic acid having a sulfonic acid group, and an organic acid having a phosphoric acid group. More specifically, examples of such acid include citric acid, isocitric acid, tartaric acid, malic acid, hydroxybutyric acid, glyceric acid, glycolic acid, oxalic acid, malonic acid, succinic acid, propanetricarboxylic acid, butanetetracarboxylic acid, maleic acid, glutaric acid, adipic acid, methansulfonic acid, and ethanesulfonic acid.

From the viewpoint of structure stability, the organic acid is more preferably a solid acid having a melting point of 100° C. or more. In addition, from the viewpoint of prevention of yellowing of the recording medium, the organic acid is especially preferably multifunctional hydroxy acid.

Thus, the organic acid is especially preferably citric acid, malic acid, or tartaric acid, which are multifunctional hydroxy acids each having a pKa of lower than 4.5 and a melting point of 100° C. or more.

These organic acids may be individually used, or two or more of these organic acids may be used in combination.

Polyvalent Metal Salt

Examples of the polyvalent metal salt include salts constituted by multivalent metal ions and acids as follows:

Specifically, examples of the multivalent metal ions include aluminium ions, barium ions, calcium ions, copper ions, iron ions, magnesium ions, manganese ions, nickel ions, tin ions, titanium ions, and zinc ions.

Examples of the acids include hydrochloric acid, bromic acid, hydroiodic acid, sulfuric acid, nitric acid, phosphoric acid, thiocyanic acid, and the organic carboxylic acid (organic acid having a carboxylic acid group) described above.

Cationic Polymer

Examples of the cationic polymer include primary amine resins such as polyallylamine, polyvinylamine, copolymers including these amines, and salts thereof and secondary amine resins such as polyethyleneimine, polydiallyl amine, copolymers including these amines, and salts thereof.

Compound A Having Polyalkylene Glycol Ether Structure and Including Only One Hydroxy Group The compound A used in the present invention has a hydroxy group and a polyalkylene glycol ether structure, and thus, can serve as a surfactant.

The compound A is a compound having one hydroxy group and an alkyl chain having six or more carbon atoms. In particular, the compound A used in the present invention is preferably a compound having six or more units of alkyleneoxy groups in the polyalkylene glycol ether structure for satisfying the cloud point described below.

Since the compound A used in the present invention is a compound whose cloud point is a specific temperature or more, the compound A easily comes to be in a phase inversion state. The cloud point of the component A measured in a 1% by mass concentration aqueous solution of the component A is 50° C. or more. In a case where the cloud point of the compound A is 50° C. or more, the treatment liquid can be easily uniformly applied onto the recording medium. The cloud point of the compound A is preferably 60° C. or more from the viewpoint of maintenance of uniformity in application of the treatment liquid upon drying with heat. Although the upper limit of the cloud point in this measuring method is 100° C. from the viewpoint of the boiling point of water, a compound for which the cloud point is not observed up to 100° C. but can be observed by, for example, changing the concentration is also usable. In this case, the cloud point in this measuring method is higher than 100° C. (>100° C.)

The 1% by mass concentration aqueous solution of the compound A is an aqueous solution consisting of the compound A, which is a target of measurement, and water, and does not contain other components. The cloud point of the compound A can be measured in the following manner. Specifically, first, a 1% by mass concentration aqueous solution of the compound A as a target of measurement is placed in a test tube and the test tube is sealed, thereby preparing an ampule. Next, while the ampule is sufficiently shaken in a constant temperature bath, the temperature in the constant temperature bath is increased at a heating rate of about 1° C. per ten minutes, and the temperature at which the ampule becomes turbid is measured. Thereafter, the temperature in the constant temperature bath is reduced from a high temperature (e.g., 80° C.) at a cooling rate of about 1° C. per 10 minutes, and the temperature at which the turbidity in the ampule disappears is measured. The intermediate temperature between the above two temperatures is defined as a cloud point. The precision of the cloud point in this measurement is within ±0.2° C. In a case where it is difficult to determine a cloud point definitely, the ampule is held in the constant temperature bath for a long time at a constant temperature, and the intermediate temperature between a limit temperature showing two-phase separation and a temperature showing a homogeneous phase is defined as a cloud point.

The structure of the compound A is not specifically limited as long as the compound A has a polyalkylene glycol ether structure in its molecular structure and has a cloud point of 50° C. or more. From the viewpoint of orientation of the compound A on the recording medium, however, the compound A is preferably a compound represented by general formula (1):

$$C_nH_{2n+1}—[(OCH(CH_3)CH_2)x(OCH_2CH_2)y]—OH \quad (1)$$

where n is an integer of 8 or more to 16 or less, x is an integer of 0 or more to 8 or less, and y is an integer of 6 or more to 20 or less.

The alkyl group at a terminal of the compound A represented by general formula (1) preferably has eight or more carbon atoms (i.e., n is 8 or more), and more preferably has ten or more carbon atoms (i.e., n is 10 or more) from the viewpoint of keeping the surface charge neutral. From the viewpoints of compatibility in an aqueous treatment liquid (reaction liquid) and stability of the treatment liquid, the alkyl group preferably has 16 or less carbon atoms (i.e., n is 16 or less), and more preferably has 14 or less carbon atoms (i.e., n is 14 or less).

From the viewpoint of water-solubility, as represented by general formula (1), the polyalkyleneoxy group in the polyalkylene glycol ether structure of the compound A includes at least an ethyleneoxy group and can include both a propyleneoxy group and an ethyleneoxy group.

More specifically, the number of repeating units of propyleneoxy groups in the structure (i.e., x in general formula (1)) is 8 or less and preferably 5 or less, from the viewpoints of the cloud point and water-solubility. In particular, from the viewpoint of the cloud point, x is preferably 3 or less. To facilitate phase inversion, moving and orientation on the recording medium, the compound A is preferably in a liquid state at room temperature (25° C.). If a propyleneoxy group showing steric hindrance is present in the molecular structure of the compound A represented by general formula (1) described above, the compound A gets in a liquid state. Thus, x is 1 or more, and more preferably 2 or more.

The number of repeating units of ethyleneoxy groups in the structure (i.e., y in general formula (1)) is 6 or more and preferably 8 or more, from the viewpoint of hydrophilicity. The number of repeating units of ethyleneoxy groups is 20 or less and preferably 12 or less, from the viewpoint of lipophilicity.

From the viewpoint of compatibility with the treatment liquid, the sum of x and y (x+y) is preferably 8 or more, and more preferably 10 or more. The sum (x+y) is preferably 20 or less, and more preferably 18 or less.

The compound A having the polyalkylene glycol ether structure used in the present invention can be obtained by performing addition polymerization of propylene oxide with respect to a higher alcohol, as desired, under pressurization in the presence of a small amount of an alkaline catalyst and then performing addition polymerization of ethylene oxide.

Examples of the compound A include commercially available products such as ADEKATOL Series produced by ADEKA Corporation, LEOX series produced by Lion Corporation, EMULGEN series produced by Kao Corporation, and WONDER SURF series produced by Aoki Oil Industrial Co., Ltd. (each of which is a product name).

Contents of Components in Treatment Liquid

From the viewpoint of blocking resistance, the total content of the component A having the polyalkylene glycol ether structure with respect to the total mass (100% by mass) of the treatment liquid is preferably 0.1% by mass or more to 10% by mass or less. The total content of the compound A is more preferably 0.3% by mass or more to 5% by mass or less.

From the viewpoint of advantages of rapid aggregation reaction with the treatment liquid, the total content of the organic acid that is an ink-viscosity-increasing component with respect to the total mass of the treatment liquid is preferably 30% by mass or more to 99% by mass or less, and more preferably 40% by mass or more to 70% by mass or less. In consideration of advantages of the present invention, the proportion of the organic acid/compound A (in terms of mass ratio) is preferably 5 or more to 200 or less, and more preferably 8 or more to 170 or less. The treatment liquid can further contain another ink-viscosity-increasing component such as the polyvalent metal salt described above as well as the combination of an organic acid and a primary higher alcohol.

From the viewpoints of aggregation reactivity and stability of solubility in the treatment liquid, the total content of the polyvalent metal salt with respect to the total mass of the treatment liquid is preferably 2% by mass or more to 90% by mass or less, and more preferably 5% by mass or more to 50% by mass or less. From the viewpoints of aggregation reactivity and stability of solubility in the treatment liquid, the total content of the cationic polymer with respect to the total mass of the treatment liquid is preferably 2% by mass or more to 50% by mass or less, and more preferably 5% by mass or more to 30% by mass or less.

Other Components

Solvent (or Dispersion Medium)

As described above, the treatment liquid according to the present invention may contain an appropriate amount of a solvent such as water or an organic solvent.

Examples of the solvent include water and a mixed solvent of water and an organic solvent (e.g., water-soluble organic solvent). Preferred examples of the organic solvent include the following solvents: alkanediols such as 1,3-butanediol, 1,5-pentanediol, 1,2-hexanediol, and 1,6-hexanediol; glycol ethers such as diethylene glycol monomethyl (or ethyl) ether and triethylene glycol monoethyl (or butyl) ether; alkyl alcohols having 1 to 4 carbon atoms, such as ethanol, isopropanol, n-butanol, isobutanol, secondary butanol, and tertiary butanol; carboxylic acid amids such as N,N-dimethylformamide, N,N-dimethylacetamide, 2-pyrrolidone, N-methyl-2-pyrrolidone, 1,3-dimethyl-2-imidazolidinone, and 2-imidazolidinone, and urea derivatives; ketones such as acetone, methyl ethyl ketone, and 2-methyl-2-hydroxy pentane-4-one, and keto-alcohols; cyclic ethers such as tetrahydrofuran and dioxane; alkylene glycols such as ethylene glycol, diethylene glycol, triethylene glycol, tetraethylene glycol, 1,2- or 1,3-propylene glycol, 1,2- or 1,4-butylene glycol, polyethylene glycol, and polypropylene glycol; polyhydric alcohols such as glycerin, 1,2,6-hexanetriol, acetylene glycol derivatives, glycerin ethylene glycol addition derivatives, and glycerin propylene glycol addition derivatives; and sulphur-containing compounds such as thiodiglycol, bishydroxyethyl sulfone, and dimethyl sulfoxide.

One type of the organic solvent may be used alone, or two or more types of organic solvents may be selected and used in combination. Of course, attention should, however, be given to some types of solvents that can affect the treatment liquid and the ink in some cases.

Investigation of the inventors of the present invention reveals that from the viewpoint of influence on coloring degradation of a recording medium, the organic solvent is preferably a water-soluble organic solvent (water-soluble compound) having no hydroxy groups or an organic solvent having only one hydroxy group and having a low SP value (SP value of 23 or less). In the case of using a polyhydric alcohol as an organic solvent, the organic solvent preferably has a high SP value (SP value of 30 or more).

In a case where the treatment liquid contains a small amount of water, the organic acid used as the ink-viscosity-increasing component especially tends to react with hydroxy groups in the water-soluble organic solvent to degrade long-term shelf life of the treatment liquid. Thus, in the present invention, the organic solvent is preferably a water-soluble organic solvent having no hydroxy groups.

In the case of using an organic solvent having a hydroxy group, although a mechanism is not clear, the specific organic solvent described above is preferably used based on the following assumption.

It is assumed that organic solvents each having a plurality of hydroxy groups and an SP value of 22.6 or more to less than 30 are both hydrophilic and hydrophobic, and thus, show the following properties. Specifically, it is assumed that these organic solvents tend to permeate paper fibers and absorb moisture, and thus, degradation caused by acid readily proceeds to promote paper degradation such as yellowing.

On the other hand, it is also assumed that an organic solvent having only one hydroxy group and an SP value of 23 or less tends to permeate paper fibers, the hydroxy group of the organic solvent faces toward the paper fibers and a hydrophobic part of the organic solvent faces toward the surface so that the organic solvent does not tend to absorb moisture and, as a result, paper degradation does not occur easily. It is further assumed that even in the case of polyhydric alcohols, an organic solvent having an SP value of 30 or more is highly hydrophilic and does not tend to permeate paper fibers and rather is taken into an organic acid, and thus, does not contribute to paper degradation.

The SP value (solubility parameter) of a water-soluble organic solvent is a value expressed by a square root of molecule aggregation energy, and can be calculated by a method described in R. F. Fedors, Polymer Engineering Science, 14, p. 147 (1974). The value is expressed with the unit $(MPa)^{1/2}$ and is obtained at 25° C.

Additive

The treatment liquid can be prepared by adding another surfactant different from the compound A and suitably adjusting the surface tension of this surfactant.

As this surfactant, known surfactants such as ionic surfactants, nonionic surfactants, cationic surfactants, and anionic surfactants are suitably selected for use as necessary. It should be noted that, of course, some types of surfactants can affect the treatment liquid and ink to have an influence on image formation, and thus, cautions are necessary in using such surfactants.

Into the treatment liquid, a neutralizer may be added in order to adjust the hydrogen ion concentration (pH). Examples of the neutralizer include potassium hydroxide, calcium hydroxide, and sodium hydroxide.

To provide the treatment liquid with desired properties as necessary, an antifoaming agent, a preservative, or a mildew proofing agent, for example, may be added in addition to the above-described components.

Ink

Ink used in the present invention can be, for example, an anionic ink containing a coloring material (e.g., dye or pigment). In addition to the coloring material, the ink can contain resin particles and a pigment dispersant, and also contain a water-soluble resin, a surfactant, a pH adjuster, and an appropriate amount of other components such as water and an organic solvent, as necessary. From the viewpoint of ink stability, the ink preferably contains an anionic dye or an anionic pigment dispersion, as a coloring material.

The ink containing the anionic pigment dispersion can be an ink containing at least one of a pigment dispersant having an anionic functional group (e.g., carboxyl group) or a self-dispersible pigment having an anionic functional group.

Resin Particles

In the present invention, the term "resin particles" means a resin that has a particle size and is dispersed in a dispersion medium. In the present invention, from the viewpoint of ink jet discharge performance, the 50% cumulative volume average particle diameter ($D_{50}$) of the resin particles is preferably 10 nm or more to 1,000 nm or less, and more preferably 40 nm or more to 500 nm or less. In the present invention, $D_{50}$ of resin particles can be measured in the following manner. Specifically, target resin particles are 50 times diluted (on volume basis) with pure water and subjected to measurement with an UPA-EX150 (product name, manufactured by NIKKISO CO., LTD.) under the following conditions: Set-Zero of 30 s; number of measurements of 3 times; measurement time of 180 seconds; and refractive index of 1.5.

From the viewpoint of ink jet discharge performance, the weight average molecular weight of the resin particles measured by gel permeation chromatography (GPC) in terms of polystyrene is preferably 1,000 or more to 2,000,000 or less.

From the viewpoint of image formation, the content (% by mass) of the resin particles in the ink with respect to the total mass of the ink is preferably 3% by mass or more to 20% by mass or less, more preferably 3% by mass or more to 15% by mass or less, and much more preferably 5% by mass or more to 10% by mass or less. From the viewpoint of image stability, the content (% by mass) of the resin particles in the ink with respect to the total mass of the ink is preferably 0.2 times or more to 100 times or less as large as the content (% by mass) of the coloring material.

Any type of resin particles may be used for the ink as long as the conditions of the resin particles described above are satisfied. The resin particles can be made of a resin obtained by homopolymerizing or copolymerizing (e.g., random copolymer, block copolymer, or graft copolymer) of one or more types of monomers. Monomers used for resin particles may be any type as long as these monomers can be polymerized by a polymerization method such as emulsion polymerization, suspension polymerization, or dispersion polymerization. Resin particles, such as those of an acrylic resin, a vinyl acetate resin, an ester resin, an ethylene resin, a urethane resin, a synthetic rubber resin, a vinyl chloride resin, a vinylidene chloride resin, and an olefin resin, can be prepared by changing the type of monomers used for resin particles. Among these resins, from the viewpoint of controlling resin properties, at least one of acrylic resin particles and urethane resin particles is preferably used as the resin particles. In the case of using an anionic ink, anionic resin particles are preferably used as the resin particles. Examples of the anionic resin particles include a copolymer of (meth) acrylic acid monomers and acrylic monomers having a hydrophobic group.

Acrylic Resin Particles

Examples of monomers usable for acrylic resin particles include α,β-unsaturated carboxylic acids and salts thereof, such as (meth)acrylic acid, maleic acid, crotonic acid, angelic acid, itaconic acid, and fumaric acid; ester compounds of α,β-unsaturated carboxylic acid esters, such as ethyl(meth)acrylate, methyl(meth)acrylate, butyl(meth) acrylate, methoxyethyl(meth)acrylate, ethoxyethyl(meth) acrylate, diethylene glycol(meth)acrylate, triethylene glycol (meth)acrylate, tetraethylene glycol(meth)acrylate, polyethylene glycol(meth)acrylate, methoxydiethylene glycol(meth)acrylate, methoxytriethylene glycol(meth)acrylate, methoxytetraethylene glycol(meth)acrylate, methoxypolyethylene glycol(meth)acrylate, cyclohexyl(meth) acrylate, isobornyl(meth)acrylate, N,N-dimethylaminopropyl(meth)acrylate, monobutyl maleate, and dimethyl itaconate; α,β-unsaturated carboxylic acid alkylamides, such as (meth)acrylamide, dimethyl(meth) acrylamide, N,N-dimethylethyl(meth)acrylamide, N,N-dimethylpropyl(meth)acrylamide, isopropyl(meth)acrylamide, diethyl(meth)acrylamide, (meth)acryloyl morpholine, maleic acid monoamide, and crotonic acid methylamide; aryl-group-containing α,β-ethylenic unsaturated compounds, such as styrene, α-methylstyrene, phenylvinyl acetate, benzyl(meth)acrylate, and 2-phenoxyethyl(meth) acrylate; and esters of polyfunctional alcohols, such as ethylene glycol diacrylate and polypropylene glycol dimethacrylate. For example, (meth)acrylic acid means one or both of methacrylic acid and acrylic acid.

As described above, the resin particles may be made of a homopolymer produced by polymerizing single monomers or a copolymer produced by polymerizing two or more types of monomers. In the case where the resin particles are made of a copolymer, the copolymer may be a random copolymer or a block copolymer. From the viewpoints of dispersion stability and image fastness, however, acrylic resin particles are preferably resin particles made of a copolymer using hydrophilic monomers and hydrophobic monomers.

Examples of the hydrophilic monomers include α,β-unsaturated carboxylic acids and salts thereof. Examples of the hydrophobic monomers include α,β-unsaturated carboxylic acid esters and aryl-group-containing α,β-ethylenic unsaturated compounds.

Urethane Resin Particles

Urethane resin particles are resin particles synthesized by causing reaction between a polyisocyanate, which is a compound having two or more isocyanate groups, and a polyol compound, which is a compound having two or more hydroxyl groups. The urethane resin particles may be any type of urethane resin particles obtained by causing reaction between a known polyisocyanate compound and a known polyol compound as long as the conditions of the resin particles described above are satisfied.

Structure of Resin Particles

The resin particles have a single-layer structure or a multi-layer structure having a core-shell structure. In the present invention, resin particles having a multi-layer structure are preferably used. In particular, resin particles having a core-shell structure are more preferably used. Since the resin particles have a core-shell structure, functions are clearly separated between a core part and a shell part. Resin particles having such a core-shell structure can advantageously provide ink with a larger number of functions than resin particles having a single-layer structure. In other words, as the resin particles, at least one of core-shell acrylic resin particles and core-shell urethane resin particles are preferably used.

Pigment

Ink preferably contains pigment as a coloring material. The type of the pigment usable in the present invention is not specifically limited, and known black pigments or known organic pigments can be used. Specifically, pigment that can be expressed by color index (C.I.) number can be used. From the viewpoint of concealing, carbon black is preferably used as the black pigment.

It is also preferable in the present invention to use a so-called self-dispersible pigment obtained by performing surface modification of the pigment itself so that the pigment can be dispersed without using a pigment dispersant described later. Examples of the self-dispersible pigment include a self-dispersible pigment having an anionic functional group. Examples of the anionic functional group include a carboxyl group, a sulfonic acid group, and a phosphoric acid group.

From the viewpoint of colorability, the content of the pigment in the ink is preferably 0.2% by mass or more to 15.0% by mass or less, and more preferably 0.6% by mass or more to 10.0% by mass or less, with respect to the total mass of the ink.

Pigment Dispersant

A pigment dispersant that allows pigment to be dispersed may be of any type as long as the pigment dispersant can be used for a known ink jet recording method. From the viewpoints of adsorption on pigment and dispersibility of pigment, however, a water-soluble pigment dispersant having both a hydrophilic part and a hydrophobic part in its chemical structure is preferably used. In particular, a pigment dispersant made of a copolymer (resin) obtained by using at least hydrophilic monomers and hydrophobic monomers is preferably used. The monomers used here are not specifically limited, and any known monomers may be suitably used. Specifically, examples of the hydrophobic monomers include styrene, a styrene derivative, alkyl(meth)acrylate, and benzyl(meth)acrylate. Examples of the hydrophilic monomers include acrylic acid, methacrylic acid, and maleic acid, having an anionic functional group (e.g., a carboxyl group).

From the viewpoints of ink stability and aggregation reactivity with the treatment liquid, the acid value of the pigment dispersant is preferably 0 mgKOH/g or more to 550 mgKOH/g or less. From the viewpoint of ink viscosity, the weight average molecular weight of the pigment dispersant is preferably 1000 or more to 50000 or less.

From the viewpoint of pigment dispersion stability, the mass ratio of the pigment to the pigment dispersant (pigment:pigment dispersant) is preferably in the range of from 1:0.1 to 1:3.

Other Components

As described above, in addition to the components described above, the ink may contain various additives, when necessary, such as a pH adjuster, a rust preventive, a preservative, a mildew proofing agent, an oxidation inhibitor, an antireduction agent, a water-soluble resin, a neutralizer for a water-soluble resin, and a salt. In using the ink, the surface tension of the ink is preferably adjusted by adding a surfactant to the ink as necessary.

The type of the surfactant is not specifically limited as long as the surfactant does not adversely affect storage stability and other properties of the ink. Examples of the surfactant include anionic surfactants such as fatty acid salts, sulfuric ester salts of higher alcohols, sulfuric ester salts of liquid fatty oils, alkylarylsulfonates; and nonionic surfactants such as polyoxyethylene alkyl ethers, polyoxyethylene sorbitan alkyl esters, acetylene alcohols, and acetylene glycols. Two or more of these surfactants may be suitably selected and used in combination.

The ink may additionally contain water or an organic solvent (e.g., glycerin).

Recording Medium

The type of a recording medium usable in the ink jet recording method according to the present invention is not specifically limited. Examples of the recording medium include mediums known in the fields of an ink jet recording method which is feasible for normal ink jet printing and electrophotography and the fields of offset printing, gravure printing, flexographic printing, and other printing which are not feasible for normal ink jet printing. More specifically, for the recording medium, there may be mentioned a poorly absorbable medium for offset printing paper such as cast coated paper and coated paper as well as an absorbable medium such as woodfree paper. The recording medium may be an intermediate transfer member. In the case of using an intermediate transfer member as the recording medium, in the ink jet recording method according to the present invention, an image (also referred to as an intermediate image) is formed on the intermediate transfer member by a treatment liquid application step and an ink application step, which will be described later. The intermediate image is transferred from the intermediate transfer member, which is a first recording medium, onto a second recording medium such as paper.

Ink Jet Recording Method

An ink jet recording method (image forming method) according to the present invention includes the step of applying a specific treatment liquid onto a recording medium (treatment liquid application step) and the step of applying an ink onto the recording medium (ink application step). In this manner, the treatment liquid and the ink come into contact with each other on the surface of the recording medium so that an image is formed on the recording medium. As the treatment liquid and the ink, a set of the treatment liquid and the ink described above can be used. In the present invention, the ink application step may be performed with the treatment liquid remaining on the surface of the recording medium after the treatment liquid application step, the treatment liquid application step and the ink application step may be performed in parallel (at the same time), or alternatively, the treatment liquid application step may be performed immediately after the ink application step (before the ink dries). In the case of performing the treatment liquid application step after the ink application step, however, the treatment liquid is preferably applied before ink dots overlap with each other on the recording medium. In the present invention, these steps (the treatment liquid application step and the ink application step) may be performed a plurality of times or a plurality of sets of these steps may be performed in combination. For example, the treatment liquid, the ink, and the treatment liquid may be sequentially applied in this order onto a recording medium so as to ensure aggregation of the ink.

Considering the objects of the present invention, however, the ink jet recording method preferably includes at least an operation of performing the ink application step after application of the treatment liquid.

The ink jet recording method according to the present invention may include the step of heating the recording medium (heating step) before application of the ink (e.g., between the treatment liquid application step and the ink application step) and/or after application of the ink. In addition, the ink jet recording method according to the present invention may include a drying step and a fixation step, which will be described later, after the ink application step. The steps will be described in detail below.

Treatment Liquid Application Step

The treatment liquid containing the ink-viscosity-increasing component and the compound A described above is applied onto a recording medium. As a method for applying the treatment liquid, a method of discharging a treatment liquid from an ink jet recording head to apply the treatment liquid onto a recording medium or a method of applying a treatment liquid onto a recording medium with, for example, a roller may be used. The treatment liquid is applied onto at least a portion of the recording medium on which the ink is applied. Alternatively, the treatment liquid may be applied to other portions, and may be applied onto the entire surface of one side of the recording medium (a surface onto which the ink is applied), for example.

The application amount of the treatment liquid with respect to the recording medium can be suitably adjusted depending on the composition of the ink to react with the treatment liquid. From the viewpoints of uniformity and fixability of a resulting image, however, for example, the application amount of the treatment liquid with respect to the recording medium is preferably 0.3 $g/m^2$ or more to 10.0 $g/m^2$ or less, and more preferably 0.8 $g/m^2$ or more to 6.0 $g/m^2$ or less. Even in a case where the treatment liquid is applied only onto a part of the recording medium with respect to its size (area: $m^2$), the treatment liquid is assumed to be applied onto the entire surface of the recording medium, and then the application amount ($g/m^2$) of the treatment liquid is obtained. This amount preferably satisfies the range described above.

Ink Application Step

The ink described above is applied onto the recording medium (e.g., a recording medium onto which the treatment liquid has been applied). At this time, a method of discharging ink from an ink jet recording head and applying the ink onto a recording medium can be employed. The ink is applied in such a manner that the ink at least partially overlaps with a region on which the treatment liquid has been applied.

In the case of applying (providing coating of) the treatment liquid onto the recording medium with, for example, a roller, from the viewpoint of rapid aggregation reactivity, it is preferable that after application of the treatment liquid onto the recording medium, the ink is applied onto the recording medium, and then an image is formed on the recording medium. At this time, the viscosity of the treatment liquid is preferably higher than the viscosity of the ink. In the case where the viscosity of the treatment liquid is higher than the viscosity of the ink, the ink can be effectively destabilized even with a small application amount of the treatment liquid so that fixability and other properties of an image can be further enhanced. More specifically, in the case where the viscosity of the treatment liquid is higher than that of the ink, the treatment liquid more easily remains near the surface of the recording medium and tends to effectively react with the ink. After the ink reacts with the treatment liquid, the pigment in the ink remains near the surface of the recording medium, whereas an aqueous medium in the ink, for example, promptly penetrates the recording medium in the depth direction. Solid-liquid separation of the ink after the reaction of the treatment liquid is preferably performed quickly, and thus, a lower viscosity of the ink is preferable from the viewpoint of fixability of an image, for example. More specifically, in the case of applying the treatment liquid directly onto the recording medium with, for example, a roller, the viscosity of the treatment liquid is preferably 3 mPa·s or more to 10 Pa·s or less, and more preferably 10 mPa·s or more to 1 Pa·s or less. The viscosity of the ink in this case is preferably 1 mPa·s or more to 15 mPa·s or less.

In a case where both the treatment liquid and the ink are applied onto a recording medium by using an ink jet recording head, the ink may be applied after application of the treatment liquid, or the treatment liquid may be applied immediately after application of the ink, or these ways of application may be combined. In view of the objects of the present invention, however, the method preferably includes at least a case where the treatment liquid is first applied and then the ink is applied.

In the case of applying the treatment liquid and the ink onto the recording medium by using an ink jet recording head, from the viewpoint of discharge performance from the recording head, the viscosities of the treatment liquid and the ink are preferably within the following ranges. Specifically, the viscosities of the treatment liquid and the ink are preferably in the range of 1 mPa·s or more to 15 mPa·s or less, band more preferably in the range of 1 mPa·s or more to 5 mPa·s or less. In this case, from the viewpoint of discharge performance from the recording head, the surface tensions of the treatment liquid and the ink are preferably in the range from 15 mN/m to 50 mN/m, both inclusive. In addition, the treatment liquid preferably effectively reacts with an intended ink on the recording medium. Thus, to prevent bleeding of the treatment liquid on a region except an intended recording region to be recorded with the ink, the surface tension of the treatment liquid is preferably higher than the surface tension of the ink to be destabilized by using the treatment liquid within a range in which the treatment liquid can be discharged from the recording head.

Heating Step

In the present invention, a heating step is preferably performed after the treatment liquid application step so that the recording medium is heated before and/or after application of ink. Specifically, during the time period between immediately after application of the treatment liquid onto the recording medium and before application of the ink, the recording medium (the treatment liquid thereon) is heated preferably to a temperature of 30° C. or more to 80° C. or less, and more preferably to a temperature of 40° C. or more to 60° C. or less. In addition, immediately after application of the ink onto the recording medium, the recording medium is heated preferably to a temperature of 30° C. or more to 80° C. or less, and more preferably to a temperature of 40° C. or more to 60° C. or less. These heating steps can enhance the aggregation rate so that a more excellent image can be formed.

The recording medium can be heated by a known heating unit such as a heater, an air-sending unit such as a dryer, or a combination of the heating unit and the air-sending unit. More specifically, examples of the heating method include a method of heating, with a heater or other unit, a side of the recording medium opposite to a surface on which the treatment liquid is applied, a method of supply hot or heated air to the surface of the recording medium on which the treatment liquid is applied, and a heating method using an infrared ray heater. Some of these heating methods may be used in combination.

Drying Step

In the present invention, to apply the method for high-speed printing, the method preferably includes a drying step of drying the recording medium on which the ink is applied after the ink application step. In drying the recording medium, the following units (methods) can be employed. Specifically, a known heating unit such as a heater; an air-sending unit using air supply with a dryer or other units, a method of transferring or sucking a surplus liquid component on the recording medium onto another recording medium, and a combination of these units and method may be employed. The heating step described above may serve also as the drying step. The drying temperature can be 30° C. or more to 220° C. or less, for example.

Fixation Step

In the present invention, to obtain image fastness such as abrasion resistance and blocking resistance or to obtain glossiness in a case where a glossy photo quality is needed, the method preferably includes, after the drying step, a fixation step of fixing an image formed of the ink on the recording medium. As a method for fixing an image on the recording medium, one or both of a heating unit and a pressurizing unit can be used. As the fixing method, however, both the heating unit and the pressurizing unit are preferably used. The use of the pressurizing unit together with the heating unit enhances thermal conductivity upon pressurization and further enhances adhesion of an image onto the recording medium.

From the viewpoint of adhesion of a coloring material onto the recording medium, the heating temperature in heating the recording medium is preferably the minimum film forming temperature (MFT) or higher of resin particles included in the aggregate on an image drawing part. Specifically, the heating temperature is preferably 50° C. or more to 150° C. or less, and more preferably greater 60° C. or more to 140° C. or less.

From the viewpoint of providing image smoothness, the pressure (nip pressure) in pressurizing the recording medium is preferably 0.1 MPa or more to 3.0 MPa or less, and more preferably 0.1 MPa or more to 0.8 MPa or less. From the viewpoint of providing image smoothness, the nip time is preferably 1 msec. or more to 5 sec or less, and more preferably 10 msec. or more to 1 sec or less.

With the ink jet recording method according to the present invention, even in the case of conveying various recording mediums at high speed, images with high resolution, high image density and less bleeding can be obtained, and a blocking phenomenon immediately after printing can be suppressed.

Ink Jet Recording Device

A device for performing an ink jet recording method according to the present invention is not specifically limited, and may be, for example, an ink jet recording device, an ink jet recording device provided with a mechanism for applying a treatment liquid, and any device that is known in the field of the ink jet recording method. Examples of a recording head mounted on the ink jet recording device include a recording head that discharges liquid by the action of mechanical energy or thermal energy. In the present invention, from the viewpoint of high-density recording, especially a recording head that discharges liquid by the action of thermal energy is preferably used. The ink jet recording device according to the present invention may be a transfer-type ink jet recording device including an intermediate transfer member.

EXAMPLES

An ink jet recording method according to the present invention will be described hereinafter using examples and comparative examples. The present invention, however, is not limited to the following examples. In the description, the term "part(s)" is based on mass without otherwise specified.

Example 1

Preparation of Treatment Liquid

First, a treatment liquid 1 having a composition shown in Table 1 was prepared. The total mass of the treatment liquid 1 was 100 g. In Example 1, as a specific compound A, Adekatol LB103, product name, produced by ADEKA Corporation (a compound in which n was 12, x was 3, and y was 10 in general formula (1) described above) was used. The cloud point of the compound A measured by using a 1% by mass concentration aqueous solution was 60° C. The content of the organic acid in the treatment liquid 1 was 40 times as much as the content of the compound A in terms of mass ratio (organic acid/compound A).

TABLE 1

| | Composition | | | | | |
|---|---|---|---|---|---|---|
| | Ink-viscosity-increasing component | Compound A: Compound satisfying general formula (1) | | | Other components: Organic solvent Triethylene glycol butyl methyl ether | |
| Treatment liquid | Organic acid Citric acid | n 12 | x 3 | y 10 | | Water |
| Content (% by mass) | 40 | | 1 | | 10 | 49 |

Preparation of Black Pigment Dispersion Liquid

The following materials were mixed and placed in a batch type vertical sand mill (manufactured by AIMEX Co., Ltd.), and the mill was charged with 200 parts of zirconia beads having a diameter of 0.3 mm. The materials were subjected to dispersion treatment for five hours while being cooled with water. In this manner, dispersion liquid was obtained.

Raw Material 10 parts of a pigment (carbon black, product name: Monarch 1100, manufactured by Cabot Corporation), 15 parts of a resin aqueous solution (pigment dispersant) (resin: styrene-ethyl acrylate-acrylic acid copolymer, acid value: 150 mgKOH/g, weight average molecular weight: 8,000, aqueous solution of 20% by mass solid content, and neutralizer: potassium hydroxide), and 75 parts of pure water.

Then, this dispersion liquid was centrifugalized so that coarse particles were removed, and then, a black pigment dispersion liquid having a pigment concentration of 10% by mass was obtained. The black pigment dispersion liquid was used as a pigment dispersion liquid of black ink described later.

Preparation of Cyan Pigment Dispersion Liquid

A cyan pigment dispersion liquid having a pigment concentration of 10% by mass was prepared in the same manner as in the preparation of the black pigment dispersion liquid, except that C. I. Pigment Blue 15:3 was used as the pigment. The cyan pigment dispersion liquid was used as a pigment dispersion liquid of cyan ink described later.

Water-Soluble Resin Liquid

As water-soluble resin liquid 1, (water-soluble resin: styrene-butyl acrylate-acrylic acid copolymer, acid value: 121 mgKOH/g, weight average molecular weight: 7,000, and aqueous solution of 20% by mass solid content, and neutralizer: potassium hydroxide) was prepared.

Preparation of Resin Particle Dispersion

First, 18 parts of methyl methacrylate, 2 parts of 2,2'-azobis-(2-methylbutyronitrile), and 2 parts of n-hexadecane were mixed and stirred for 0.5 hours. The mixture was dropped to 78 parts of a 6% by mass concentration aqueous solution of a styrene-butyl acrylate-acrylic acid copolymer (acid value: 130 mgKOH/g, weight average molecular weight: 7,000), followed by stirring for 0.5 hours. Then, the resulting mixture was subjected to supersonic wave irradiation for 3 hours with a supersonic wave irradiator. Subsequently, the mixture was subjected to a polymerization reaction for 4 hours in a nitrogen atmosphere at 80° C., followed by cooling to room temperature (25° C.). The reaction product was then filtered to yield a resin particle dispersion 1 with a resin content of 40.0% by mass. The resin particles had a weight average molecular weight of 250,000, and an average particle diameter ($D_{50}$) of 200 nm. The MFT was observed to be 80° C.

Preparation of Ink

Two types of ink having compositions shown in Table 2 below were prepared. Specifically, the components shown in Table 2 were mixed and stirred sufficiently, and then subjected to pressure filtration through a microfilter having a pore size of 3.0 μm (manufactured by Fujifilm Corporation).

TABLE 2

| Composition | Content | Pigment dispersion liquid | Water-soluble resin liquid 1 | Glycerin | Resin particle dispersion | Surfactant Acetylenol E100 | Water |
|---|---|---|---|---|---|---|---|
| Black ink | Mass % | 20 | 17 | 7 | 25 | 1 | Balance |
| Cyan ink | Mass % | 20 | 17 | 7 | 25 | 1 | Balance |

Preparation of Printed Product

Printing was performed by using an image forming apparatus illustrated in FIGURE so that an image was formed on a recording medium.

Specifically, as the recording medium 1, cast coated paper (product name: "Mirror Coat") manufactured by Oji Paper Co., Ltd. was prepared. Then, a treatment liquid was applied onto the recording medium by using a roller 4 which is a treatment liquid application device. Subsequently, an image having a desired pattern was formed on the recording medium on which the treatment liquid was applied, with an ink jet device 5 (nozzle arrangement density: 1200 dpi, discharge amount: 4 pl) by using the cyan ink and the black ink described above. The treatment liquid was applied to the entire surface of one side of the recording medium 1, and the cyan ink and the black ink were applied onto the surface on which the treatment liquid was applied (recording surface of the recording medium).

At this time, immediately after the application of the treatment liquid, the recording medium 1 was heated to 50° C. with a heater 2. In forming the image, the first shot ink was cyan ink, the second shot ink was black ink, and the impact time difference between the cyan ink and the black ink was 70 msec. The conveying speed on a convey stage 3 of the recording medium was 1.0 m/sec.

Immediately after print image formation, the obtained recording medium was subjected to drying for four seconds with hot air at 90° C. using a heating dryer 6. In addition, the dried recording medium was caused to pass between a pair of fixing rollers 7 heated at 120° C., and was subjected to fixing under a nip pressure of 0.4 MPa, thereby obtaining a printed product. The fixing rollers were constituted by a heating roll which is an aluminium cylinder that has a heater in the inside and is coated with a silicone rubber having a thickness of 2 mm and a durometer D hardness of 20 and by an opposed roll to be pressed against the heating roll.

Evaluation (1) Image Quality Evaluation

The obtained printed product was observed for the presence of bleeding and sharpness of character quality with an optical microscope to evaluate the image quality based on the following criteria. The character quality was evaluated by using an image (character image of 3-point size) formed on a recording medium.

Evaluation Criteria

AA: no bleeding, sharp character quality

A: slight bleeding, character was clearly distinguished

B: certain bleeding, character was difficult to distinguish

C: apparent bleeding, character is not distinguished

In the image quality evaluation, an image of level B or better in which characters of 3-point size can be distinguished was taken to have high quality.

(2) Blocking Evaluation

Blocking evaluation on an image non-drawing part (surface portion of the recording medium on which only the treatment liquid was applied) of the obtained printed product was performed under the following conditions. Specifically, two obtained printed products were left at a temperature of 23° C. and a relative humidity of 50% for 30 minutes. Subsequently, the two printed products were stacked with the surfaces of their image non-drawing parts on which the treatment liquid was applied being in contact with each other. Then, on the assumption that 500 sheets of 128 g/m$^2$ paper were stacked on these printed products, the printed products were left under a load of 64 kg/m$^2$ for 24 hours under the conditions described above. After being left, the condition of the overlaid printed products (samples) was observed and evaluated based on the following criteria.

Evaluation Criteria

0: Samples do not stick to each other at all.

−1: Samples are separated only by a touch.

−2: Samples are not separated when being inverted but are easily separated when being shaken with the upper sample being fixed.

−3: Samples are not separated when being shaken but can be peeled off quietly.

−4: Samples are not easily separated and generate noise when being peeled off.

−5: Setoff of treatment liquid or ink occurs on the surface on which the treatment liquid or ink is applied, or the base material (a paper sheet or a coating layer) of the recording medium used is peeled.

The two evaluations were conducted by using the printed products obtained in Example 1 to find that the result of the image quality evaluation was AA and the result of the blocking evaluation was 0 with no blocking phenomenon.

Example 2

Treatment liquid 2 having a composition shown in Table 3 below was prepared in the same manner as the preparation in Example 1, except that the organic solvent used for preparing the treatment liquid 1 was replaced by 1,5-pentanediol.

TABLE 3

| | Composition | | | | | |
|---|---|---|---|---|---|---|
| | Ink-viscosity-increasing component | Compound A Compound satisfying General formula (1) | | | Other components | |
| Treatment liquid | Organic acid Citric acid | n 12 | x 3 | y 10 | Organic solvent 1,5-pentanediol | Water |
| Content (% by mass) | 40 | | 1 | | 10 | 49 |

Then, a printed product was prepared in the same manner as in the preparation in Example 1, except that the treatment liquid 2 was used, and image quality evaluation and blocking evaluation were conducted on the obtained printed products. The result of the image quality evaluation on the printed products in Example 2 was AA, and the result of the blocking evaluation was 0 with no blocking phenomenon.

Comparative Example 1

Treatment liquid 3 having a composition shown in Table 4 below was prepared in the same manner as the preparation of the treatment liquid 1 in Example 1, except that the specific compound A was not added and the content of water was changed to 50% by mass.

TABLE 4

| | Composition | | | |
|---|---|---|---|---|
| | Ink-viscosity-increasing component | | Other components | |
| Treatment Liquid | Organic acid Citric acid | Compound A Not added | Organic solvent Triethylene glycol butyl methyl ether | Water |
| Content (% by mass) | 40 | 0 | 10 | 50 |

Then, a printed product was prepared in the same manner as in the preparation in Example 1, except that the treatment liquid 3 was used, and image quality evaluation and blocking evaluation were conducted on the obtained printed products. In Comparative Example 1, although the result of the image quality evaluation on the printed products was AA, the result of the blocking evaluation was −5 because the samples were bonded together and thus the base material of the recording medium was peeled when being separated.

Comparative Example 2

Treatment liquid 4 having a composition shown in Table 5 below was prepared in the same manner as in the preparation of the treatment liquid 1 in Example 1, except that the specific compound A was replaced by nonionic surfactant ACETYLENOL E100 (product name, manufactured by Kawaken Fine Chemicals Co., Ltd.) having two hydroxy groups.

TABLE 5

| | Composition | | | |
|---|---|---|---|---|
| | Ink-viscosity-increasing component | | Other components | |
| Treatment liquid | Organic acid Citric acid | Surfactant ACE-TYLENOL E100 | Organic solvent Triethylene glycol butyl methyl ether | Water |
| Content (% by mass) | 40 | 1 | 10 | 49 |

Then, a printed product was prepared in the same manner as the preparation in Example 1, except that the treatment liquid 4 was used, and image quality evaluation and blocking evaluation were conducted on the obtained printed products. In Comparative Example 2, although the result of the image quality evaluation on the printed products was AA, the result of the blocking evaluation was −5 because the samples were bonded together and thus the base material of the recording medium was peeled when being separated.

Examples 3 to 9, Comparative Examples 3 to 4

Treatment liquids 5 to 11 were prepared in the same manner as in the preparation in Example 1, except that the specific compound A used in the treatment liquid 1 was replaced by a compound (compound A) where n, x, and y in general formula (1) described above were as follows. Each of the compounds used in the treatment liquids 5 to 11 had a cloud point of 50° C. or more with a 1% by mass concentration aqueous solution.

In addition, treatment liquids 12 and 13 were prepared in the same manner as in the preparation in Example 1, except that the specific compound A used in the treatment liquid 1 was replaced by a compound where n, x, and y in general formula (1) described above were as follows. Each of the compounds used in the treatment liquids 12 and 13 had a cloud point less than 50° C. with a 1% by mass concentration aqueous solution.

Then, printed products were prepared in the same manner as in the preparation in Example 1, except that the treatment liquids described above were used, and image quality evaluation and blocking evaluation were conducted on the obtained printed products. Table 6 shows the numbers of treatment liquids used in the examples and the comparative examples and evaluation results thereof.

TABLE 6

| Example | Treatment | Compound A General Formula (1) | | | Cloud point | Evaluation result | |
|---|---|---|---|---|---|---|---|
| No. | liquid No. | n | x | y | (° C.) | Bleeding | Blocking |
| Example 3 | 5 | 12 | 3 | 8 | 54 | AA | 0 |
| Example 4 | 6 | 12 | 3 | 12 | 75 | A | 0 |
| Example 5 | 7 | 12 | 3 | 15 | 77 | A | 0 |
| Example 6 | 8 | 8 | 0 | 6 | 56 | AA | −2 |
| Example 7 | 9 | 13 | 0 | 10 | 75 | A | −1 |
| Example 8 | 10 | 12 | 0 | 12 | >100 | A | −1 |
| Example 9 | 11 | 13 | 2 | 14 | 50 | A | 0 |
| Comparative Example 3 | 12 | 6 | 0 | 2 | 25° C. or less | AA | −5 |
| Comparative Example 4 | 13 | 12 | 0 | 3 | 25° C. or less | AA | −5 |

Examples 10 to 14

Treatment liquids 14 to 18 were prepared in the same manner as in the preparation in Example 1, except that the content of the specific compound A in the treatment liquid 1 was changed and, accordingly, the content of water was changed so that the entire treatment liquid corresponds to 100% by mass. Then, printed products were prepared in the same manner as in the preparation in Example 1, except that the treatment liquids described above were used, and image quality evaluation and blocking evaluation were conducted on the obtained printed products. Table 7 below shows the numbers of treatment liquids used in the examples, the contents (% by mass) of the specific compound A and water in each treatment liquid, the mass ratio of organic acid (citric acid) with respect to the specific compound A in the treatment liquid, and evaluation results.

TABLE 7

| Example | Treatment | Content (% by mass) in treatment liquid | | Organic acid/ compound A | Evaluation result | |
|---|---|---|---|---|---|---|
| No. | liquid No. | Compound A | Water | (mass ratio) | Bleeding | Blocking |
| 10 | 14 | 0.3 | 49.7 | 133 | AA | −2 |
| 11 | 15 | 0.6 | 49.4 | 67 | AA | −1 |
| 12 | 16 | 2.0 | 48.0 | 20 | A | 0 |
| 13 | 17 | 5.0 | 45.0 | 8.0 | A | 0 |
| 14 | 18 | 6.0 | 44.0 | 6.7 | B | 0 |

Examples 15 to 19

Treatment liquids 19 to 23 having the compositions shown in Table 8 below were prepared in the same manner as the preparation in Example 1.

TABLE 8

| | Composition | | | | | | | |
|---|---|---|---|---|---|---|---|---|
| | Content (% by mass) | | | | | | | |
| | Ink-viscosity-increasing component | Compound A | | | Other components | | | |
| | | Compound satisfying General Formula (1) | | | | pH adjuster (base) | Organic solvent | Organic acid/ |
| Treatment liquid No. | Organic acid Citric acid | n 12 | x 3 | y 10 | Water | Potassium hydroxide | Triethylene glycol butyl methyl ether | compound A (mass ratio) |
| 19 | 50 | 0.3 | | | 34.7 | 5 | 10 | 167 |
| 20 | 50 | 2 | | | 33 | 5 | 10 | 25 |
| 21 | 30 | 2 | | | 55 | 3 | 10 | 15 |
| 22 | 20 | 1.5 | | | 66.5 | 2 | 10 | 13 |
| 23 | 10 | 1 | | | 78 | 1 | 10 | 10 |

Then, printed products were prepared in the same manner as in the preparation in Example 1, except that the treatment liquids described above were used, and image quality evaluation and blocking evaluation were conducted on the obtained printed products. Table 9 shows the numbers of treatment liquids used in the examples and evaluation results thereof.

TABLE 9

| Example | Treatment liquid | Evaluation result | |
|---|---|---|---|
| No. | No. | Bleeding | Blocking |
| 15 | 19 | AA | −2 |
| 16 | 20 | AA | 0 |
| 17 | 21 | A | 0 |
| 18 | 22 | B | 0 |
| 19 | 23 | B | 0 |

Examples 20 and 21, Comparative Examples 5 and 6

Treatment liquids 24 to 27 having the compositions shown in Table 10 below were prepared in the same manner as in the preparation in Example 1.

TABLE 10

| | Composition Content (% by mass) | | | | | | | |
|---|---|---|---|---|---|---|---|---|
| | Ink-viscosity-increasing component | Compound A Compound satisfying General Formula (1) | | | Surfactant | | Other Components pH adjuster (base) | Other Components Organic solvent |
| Treatment liquid No. | Organic acid Citric acid | n 12 | x 3 | y 10 | ACETYLENOL E100 | Water | Potassium hydroxide | 1,5-pentanediol |
| 24 | 40 | 1 | | | 0 | 44 | 5 | 10 |
| 25 | 40 | 1 | | | 0 | 44 | 5 | 0 |
| 26 | 40 | 0 | | | 1 | 44 | 5 | 10 |
| 27 | 40 | 0 | | | 1 | 44 | 5 | 0 |

Then, printed products were prepared in the same manner as in the preparation in Example 1, except that the treatment liquids described above were used, and image quality evaluation and blocking evaluation were conducted on the obtained printed products. Table 11 shows the numbers of treatment liquids used in the examples and the comparative examples and evaluation results thereof.

TABLE 11

| Example | Treatment liquid | Evaluation result | |
|---|---|---|---|
| No. | No. | Bleeding | Blocking |
| Example 20 | 24 | AA | 0 |
| Example 21 | 25 | AA | 0 |
| Comparative Example 5 | 26 | AA | −5 |
| Comparative Example 6 | 27 | AA | −5 |

Examples 22 and 23, Comparative Examples 7 and 8

Treatment liquids 28 to 31 having the compositions shown in Table 12 below were prepared in the same manner as the preparation in Example 1.

TABLE 12

| | Composition Content (% by mass) | | | | | | | |
|---|---|---|---|---|---|---|---|---|
| | Ink-viscosity-increasing component Organic acid | | Compound A Compound satisfying General Formula (1) | | | Other components | | |
| Treatment liquid No. | Malonic acid | 1,2,3-propanetricarboxylic acid | n 12 | x 3 | y 10 | Water | pH adjuster (base) Potassium hydroxide | Organic solvent Triethylene glycol butylmethyl ether |
| 28 | 40 | 0 | | 1 | | 44 | 5 | 10 |
| 29 | 0 | 40 | | 1 | | 54 | 5 | 0 |
| 30 | 40 | 0 | | 0 | | 45 | 5 | 10 |
| 31 | 0 | 40 | | 0 | | 55 | 5 | 0 |

Then, printed products were prepared in the same manner as in the preparation in Example 1, except that the treatment liquids described above were used, and image quality evaluation and blocking evaluation were conducted on the obtained printed products. Table 13 shows the number of treatment liquids used in the examples and the comparative examples and evaluation results thereof.

TABLE 13

| Example | Treatment liquid | Evaluation result | |
|---|---|---|---|
| No. | No. | Bleeding | Blocking |
| Example 22 | 28 | AA | 0 |
| Example 23 | 29 | AA | 0 |
| Comparative Example 7 | 30 | AA | −3 |
| Comparative Example 8 | 31 | AA | −5 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-124033, filed Jun. 19, 2015, which is hereby incorporated by reference herein in its entirety.

What is claimed is:

1. An ink jet recording method comprising the steps of:

applying, onto a recording medium, a treatment liquid containing (i) a component that causes an ink viscosity increase and (ii) a compound A having a polyalkylene glycol ether structure and having only one hydroxy group; and applying an ink onto the recording medium, wherein the compound A is represented by the following general formula (1):

$$C_nH_{2n+1}—[(OCH(CH_3)CH_2)x(OCH_2CH_2)y]—OH \quad (1)$$

where n is an integer of 8 or more to 16 or less, x is an integer of 1 or more to 8 or less, and y is an integer of 6 or more to 20 or less, and wherein a cloud point of the compound A, measured by using a 1% by mass concentration aqueous solution of the compound A, is 50° C. or more.

2. The ink jet recording method according to claim 1, further comprising the step of drying the ink applied onto the recording medium.

3. The ink jet recording method according to claim 1, further comprising the step of fixing the ink applied onto the recording medium.

4. The ink jet recording method according to claim 1, wherein a content of the compound A in the treatment liquid is 0.1% by mass or more to 10% by mass or less, and wherein a content of an organic acid contained in the treatment liquid and serving as the component that causes an ink viscosity increase is 30% by mass or more to 99% by mass or less.

5. The ink jet recording method according to claim 4, wherein the treatment liquid further contains a polyvalent metal salt in a content of 2% by mass or more to 90% by mass or less.

6. The ink jet recording method according to claim 4, wherein the treatment liquid further contains water and an organic solvent.

7. The ink jet recording method according to claim 6, wherein the organic solvent is selected from the group consisting of a water-soluble organic solvent having no hydroxy group, an organic solvent having only one hydroxy group and having an SP value of 23 or less, and a polyhydric alcohol having an SP value of 30 or more.

8. The ink jet recording method according to claim 1, wherein, after the step of applying the treatment liquid onto the recording medium, the step of applying the ink onto the recording medium is performed with the treatment liquid remaining on the recording medium.

9. The ink jet recording method according to claim 1, wherein, after the step of applying the ink onto the recording medium, the step of applying the treatment liquid onto the recording medium is performed before the ink dries.

10. The ink jet recording method according to claim 1, wherein the component that causes an ink viscosity increase is at least one selected from the group consisting of a polyvalent metal salt, a cationic polymer, and an organic acid.

11. The ink jet recording method according to claim 1, wherein the cloud point of the compound A, measured by using the 1% by mass concentration aqueous solution of the compound A, is 50° C. or more to 100° C. or less.

12. The ink jet recording method according to claim 1, wherein the ink contains a coloring material.

13. The ink jet recording method according to claim 12, wherein the coloring material is a pigment.

14. The ink jet recording method according to claim 1, wherein the ink contains at least one selected from the group consisting of acrylic resin particles and urethane resin particles.

* * * * *